US006023898A

United States Patent [19]

Josey

[11] Patent Number: 6,023,898

[45] Date of Patent: Feb. 15, 2000

[54] METAL FRAME BUILDING CONSTRUCTION

[75] Inventor: Gary L. Josey, Wilmington, N.C.

[73] Assignee: Ground Star, LLC, Wilmington, N.C.

[21] Appl. No.: 09/088,449

[22] Filed: Jun. 1, 1998

[51] Int. Cl.[7] ..... E04C 3/304

[52] U.S. Cl. ..... 52/309.5; 52/481.1; 52/582.1; 52/653.1; 52/653.2; 52/655.1; 52/656.9; 52/657; 52/712

[58] Field of Search ..... 52/309.5, 481.1, 52/582.1, 653.1, 653.2, 655.1, 656.9, 657, 712

[56] References Cited

U.S. PATENT DOCUMENTS

| | | | |
|---|---|---|---|
| 2,205,519 | 6/1940 | Eiber et al. . | |
| 2,815,832 | 12/1957 | Schwartz . | |
| 3,035,669 | 5/1962 | Graff . | |
| 3,203,151 | 8/1965 | Bransford, Jr. . | |
| 3,369,333 | 2/1968 | Wheeler | 52/657 |
| 3,482,369 | 12/1969 | Burke . | |
| 3,570,198 | 3/1971 | Ruhnke . | |
| 3,877,193 | 4/1975 | Hall . | |
| 4,050,498 | 9/1977 | Lucchetti | 52/657 X |
| 4,283,892 | 8/1981 | Brown . | |
| 4,588,156 | 5/1986 | Doke et al. . | |
| 4,619,098 | 10/1986 | Taylor . | |
| 4,854,096 | 8/1989 | Smolik . | |
| 5,157,883 | 10/1992 | Meyer . | |
| 5,222,335 | 6/1993 | Petrecca . | |
| 5,285,615 | 2/1994 | Gilmour . | |
| 5,394,665 | 3/1995 | Johnson . | |
| 5,440,848 | 8/1995 | Deffet . | |
| 5,464,302 | 11/1995 | Menchetti . | |
| 5,497,591 | 3/1996 | Nelson . | |
| 5,596,859 | 1/1997 | Horton et al. . | |
| 5,625,997 | 5/1997 | Callahan et al. . | |
| 5,857,306 | 1/1999 | Pellock | 52/656.9 X |

*Primary Examiner*—Christopher T. Kent
*Attorney, Agent, or Firm*—Rhodes & Mason, PLLC

[57] ABSTRACT

Metal building framing components are joined with double-sided adhesive tape positioned between the first connection surface of a first metal framing component and a second connection surface of a second metal framing component. The connection surfaces may be a wall surface or the surface of a tab projecting from the end of a wall. The double-sided adhesive tape is formed of a closed-cell acrylic foam carrier having pressure sensitive adhesive on both sides.

24 Claims, 4 Drawing Sheets

50'
54'
58'
4
50
54
66
60
62
68
52
56'
5
56
4

58
54
70
64
60
66
62
68
56

54'
58'
64
66
60
54
58

72
74
78
80
82
84
86
88
90
92
94
96
98
100
102
104
106
108
110
112

METAL FRAME BUILDING CONSTRUCTION

BACKGROUND OF THE INVENTION (1) Field of the Invention

The present invention relate s genera lly to improvements in the construction of metal frame buildings, and in particular to improvements in the attachment of metal frame building components.

(2) Description of the Prior Art

Residential and commercial buildings historically have been constructed of a wooden frame formed of lumber components that have been nailed to each other to form the desired structure. While this technique is still used in the majority of residential buildings, there has been a trend toward replacement of the wooden framing members, either partially or entirely, with metal framing components. This trend is due to several factors, including the ease of handling, the availability of wood, fire resistance and, particularly in coastal areas, the need for buildings that will withstand high wind forces.

Generally, these metal frames are constructed with elongated hollow metal framing members having dimensions equal to standard lumber dimensions of 2×4s, 2×6s and 2×8s as substitutes for conventional wooden lumber. It will be understood by one skilled in the art that lumber dimensions are not the same as inches. For example, a 2×4 is actually 1.75 inches×3.5 inches. However, standard lumber dimensions will be used herein for convenience.

Major framing components, such as I-beams, are usually joined by welding. Some framing components are welded or bolted to a common plate. Many metal framing components, however, are normally attached with screws. Usually, the end of one component is inserted into a recess between two walls of another component and a plurality of screws are inserted through abutting walls of the two components. For example, in the construction of a metal frame wall an elongated, channel-shaped connector plate or beam having a horizontal bottom wall and upright side walls extending upwardly from the edges of the bottom wall is secured to the building floor or foundation.

The lower ends of a plurality of evenly spaced C-shaped studs are then mounted vertically in the plate, resting on the bottom wall. Each stud has a side wall and opposed end walls that abut the inner surfaces of the beam side walls when the stud is in position. Metal screw are then inserted from the exterior of the beam through the beam side walls and the abutting stud end walls to secure the studs to the beam.

This procedure is described, for example, in U.S. Pat. No. 4,619,098 to Taylor. U.S. Pat. No. 5,596,859 to Horton et al., while primarily concerned with the attachment of metal studs to wooden base plates, mentions that a metal plate can be used, with the stud and metal plate being joined by self-tapping screws. U.S. Pat. No. 5,440,848 to Deffet also describes attachment of a metal studs, but is concerned only with nailing to wooden attachment plates.

Other techniques have also been described in the prior art for attaching two metal building framing components. For example, U.S. Pat. No. 4,854,096 to Smolik utilizes spaced cut-outs, or "fingers," that extend inwardly from the side walls of the attachment plates, with the stud being inserted between the cut-outs. U.S. Pat. No. 5,222,335 to Petrecca and U.S. Pat. No. 5,394,665 to Johnson describe metal frame constructions using inwardly directed projections on the attachment plate side walls that mate with corresponding indentations on the stud end walls.

Prior art techniques, such as those described above, may be somewhat easier to use than screws. However, the strength of the attachment is mainly the result of friction, and thus is of little strength. Therefore, the utility of these techniques is essentially limited on interior, non-loading bearing circumstances. As noted in the above Petrecca patent, the only purpose for screws in an interior non-load bearing wall is to hold the studs in a vertical position until the dry wall is applied.

These techniques are not sufficient, however, for attachment of metal framing components in other parts of the building construction, either on the exterior of the building or the building interior, where load-bearing members are required, or where the structure is subjected to stress. Thus, there remains a need for a means of attaching metal frame building components that will withstand load-bearing forces and stresses.

SUMMARY OF THE INVENTION

The present invention is directed to metal frame building components, and to the attachment of metal framing components to each other. The present invention also describes unique structures of building framing components that facilitate such attachment.

In general, building frame components of the type described herein in greater detail, are attached using a double-sided adhesive tape positioned between adjoining surfaces of two of the components. The double-side adhesive tape is preferably a double coated acrylic foam adhesive tape, such as that sold by 3M Industrial Tape and Specialties Division, St. Paul, Minn. 55144-1000 under the trademark VHB. Such tapes are comprised of a closed-cell acrylic foam carrier tape, coated on both sides with a pressure sensitive adhesive, e.g., an acrylic pressure sensitive adhesive.

While the double-sided adhesive tape may be used to attach adjacent surfaces of any two metal frame building components, it is particularly useful in attaching metal frame components of the structures described herein. These components are normally characterized by one or more projecting tabs or flanges positioned to face a surface of the opposed component or member to which the component is to be attached. While certain components will be described herein is detail, it will be appreciated that these characteristics may be adapted to a variety of building framing components where attachment is desired.

The dimensions of the various building components may vary depending upon their use. Generally, however, the overall component dimensions will be in length and widths commonly associated with lumber used on conventional building framing. For example, framing components may be in lengths of 6, 8, 10, 12 and 14 feet or longer. As noted above, the cross-sectional dimensions of a component may be that of a conventional 2×4, 2×6, or 2×8 lumber piece.

Most framing component will be of a conventional U-shaped or C-shaped cross-section. These terms are known in the relevant industry, a U-shaped cross-section having a continuous side plate with a pair of spaced, parallel end plates extending in the same direction at 90° angle from the edges of the side plate. A component having a C-shaped cross-section additionally includes side segments extending inwardly from the outer edges of the end plates and parallel to the side plate.

In some instances, all or a part of the cross-section of the framing component will be of a rectangular or box shape, with a complete second side wall instead of the side segments joining the outer edges of the end walls. Alternatively, the box shape can be formed by extending the side segment toward each other so that their forward edges are adjacent to each other.

The metal frame components contemplated by the invention will normally be constructed of steel, having a thickness of from about 7 to about 26 gauge.

Framing components to be joined at their ends will include tabs or flanges on at least one end, or on both ends if both ends are to be joined. These tabs are integral with, and extend from the end on one of the component walls, and may be bent to position the tab parallel to the wall to which the component will be attached. The tabs may be bent outwardly or inwardly, depending upon their use.

The overall dimensions of the tabs will depend on the strength of the bond required, since the surface area of the tape applied will determine not only the strength of the bond, but also the surface area of the tab needed to support the tape. For most applications, however, a tape surface area, and thus a tab surface area, for from about 2 to about 10 square inches will be used. The framing components can also include openings or cut-outs as required. For example, metal studs may include one or more openings for insertion of electrical wiring, plumbing lines, etc.

In some instances, such as where there is a need to join abutting ends of rails or beams, the use of tabs may not provide sufficient rigidity to the structure. Therefore, the building framework may also include channel members to splice together such butt joints. These splicing members will be joined to surfaces, e.g., the inner surfaces of the rails using the above-described double-sided adhesive.

Accordingly, one aspect of the present invention is to provide a frame of a building comprising a first metal framing component having a first connection surface; a second metal framing component having a second connection surface; and double-sided adhesive tape adhering the first and second connection surfaces.

Another aspect of the present invention is to provide a frame of a building comprising a first metal framing component having a side wall with parallel side edges, first and second end walls having first side edges integral with the edges of the side wall and forward edges, and a tab at the end of one of the walls, the tab having a first connection surface; a second metal framing component having a wall with a second connection surface; and double-sided adhesive tape joining the first and second connection surfaces.

Still another aspect of the present invention is to provide aframe of a building comprising a first component having a first wall; a second component having a second wall, the first and second wall having abutting ends and lying in a common plane; a connector plate having a connection surface; and double-sided adhesive tape connecting the connection surface to the first and second walls.

Another aspect of the present invention is to provide a frame of a building comprising a first component having a top wall, parallel side walls, a bottom wall, and a first tab extending from the end of one of the walls; a second component having a top wall, parallel side walls, a bottom wall, and a second tab extending from the end of one of the walls; double-sided adhesive tape joining the first tab to a wall of the second component; and double-sided adhesive tape joining the second tab to a wall of the first component.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 2:
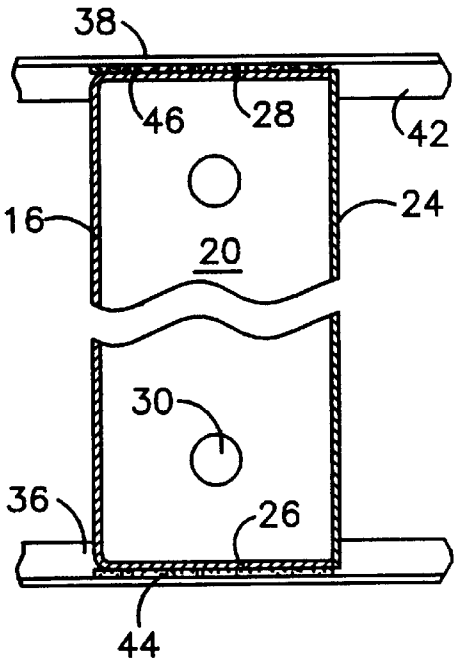
FIG. 2 is a sectional side view of the stud and plates of FIG. 1.
Figure 1:
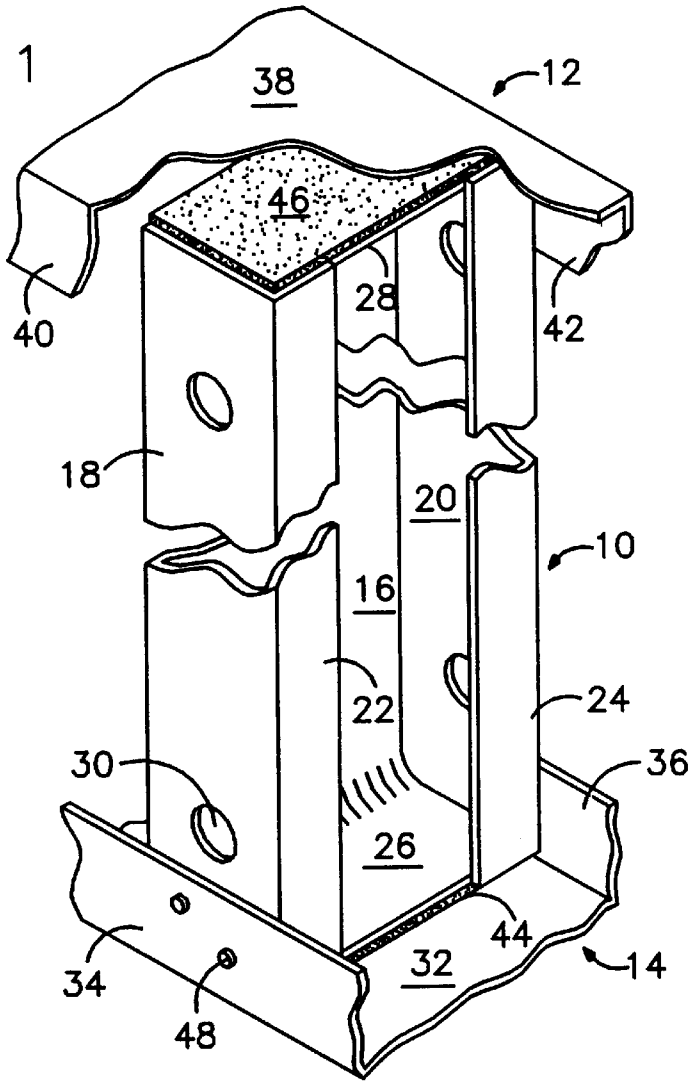
FIG. 1 is a perspective view of a metal stud with center section removed, positioned between upper and lower attachment plates.
Figures 3, 4, 5:
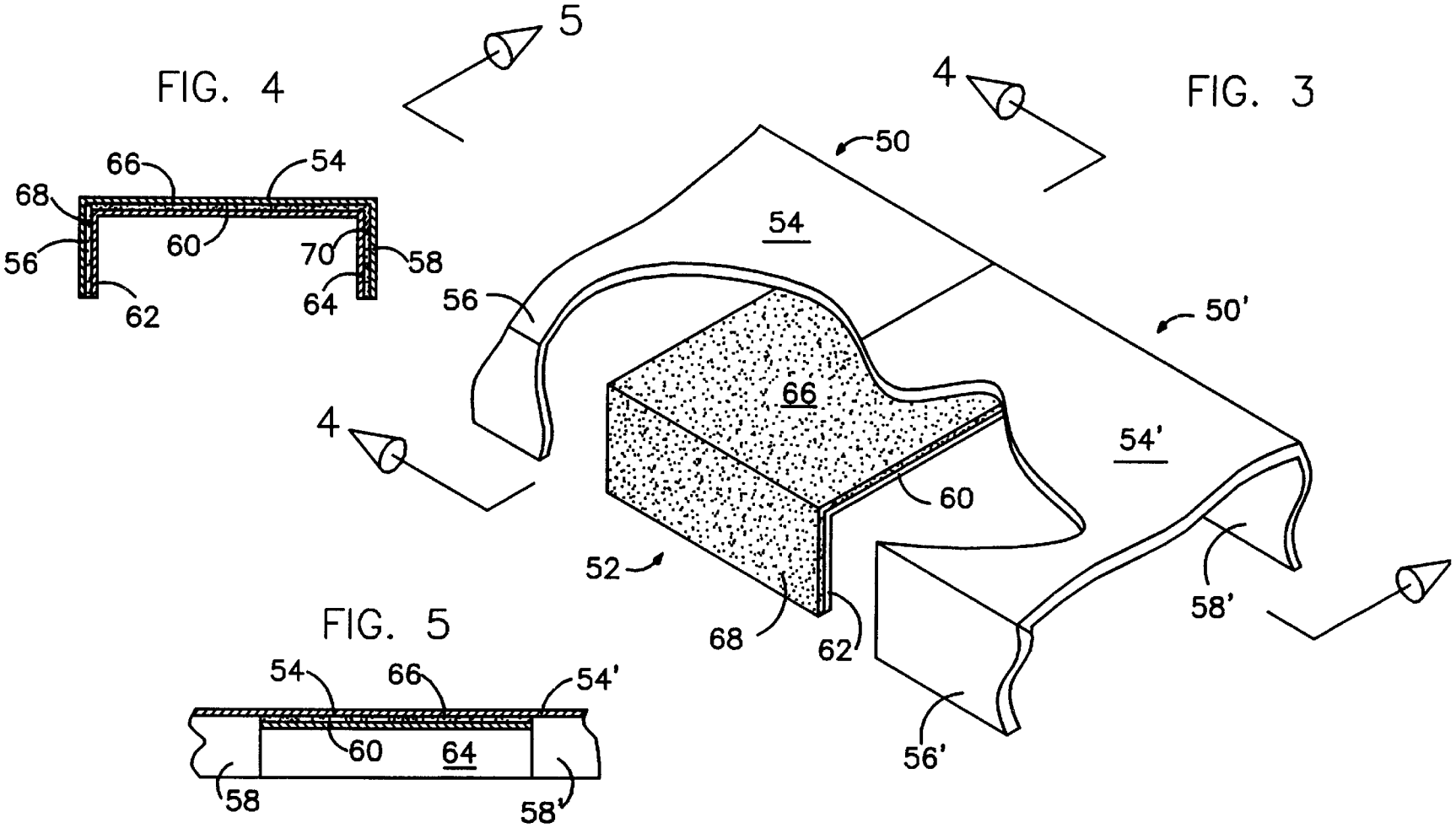
FIG. 3 is a partially cut away perspective of two abutting attachment plates with a joinder plate securing the ends of the attachment plates together.
FIG. 4 is an end view of the attachment plate and joinder plate of FIG. 3 along line 4—4.
FIG. 5 is a sectional side view of the attachment plate and joinder plate of FIG. 3 along line 5—5.
Figures 6, 7, 8:
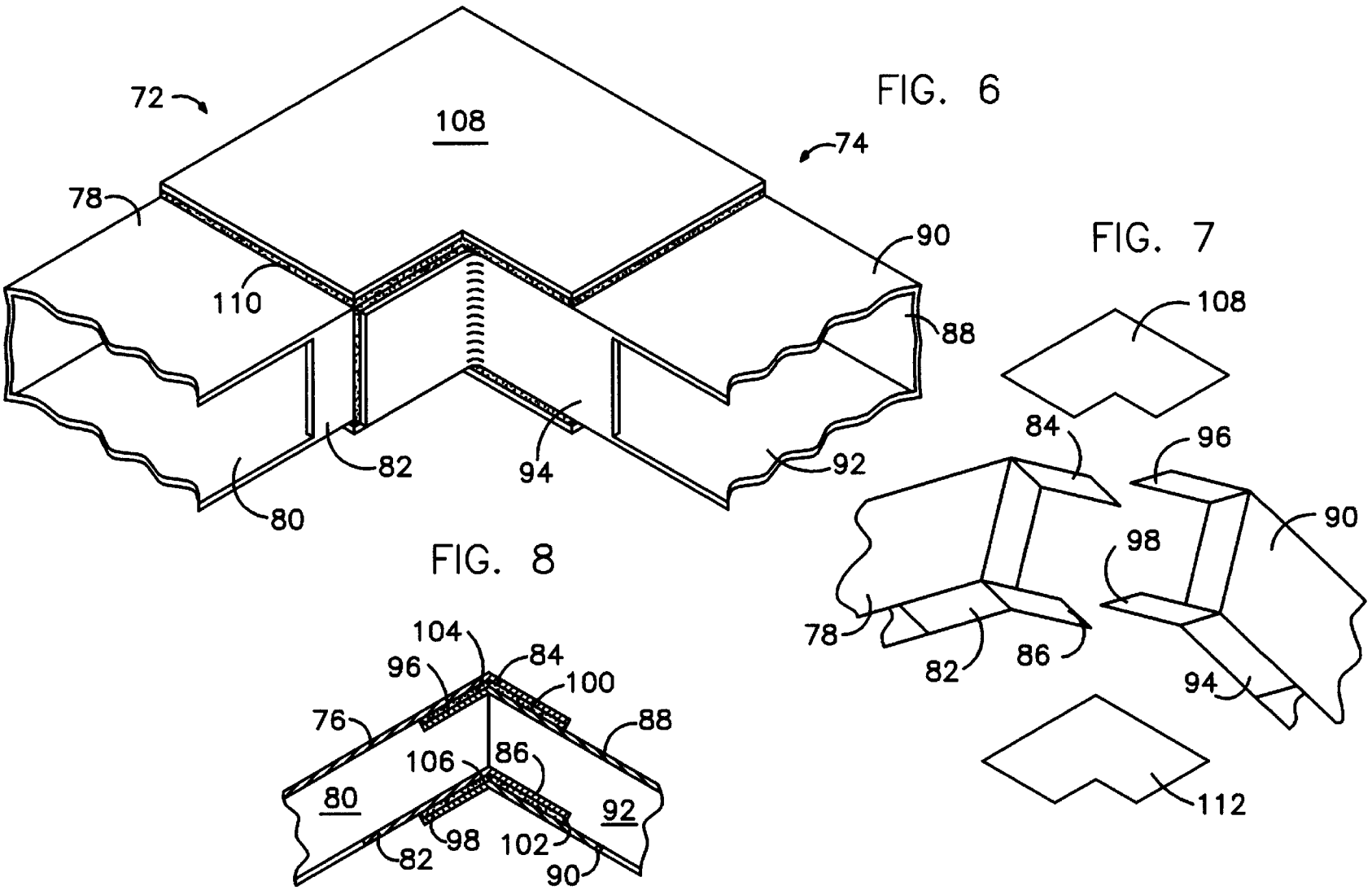
FIG. 6 is a perspective view of the joinder of the apex of two rafters.
FIG. 7 is an exploded view of FIG. 6.
FIG. 8 is a sectional side view of the joined rafters of FIG. 6.

FIGS. 1–10 illustrate various examples of metal frame building components joined by double-sided adhesive tape in accordance with the present invention. Specifically, FIGS. 1–2 illustrate the attachment of the ends of metal frame components, such as studs, to channels or other attachment plates. FIGS. 3–5 illustrate the attachment of the ends of abutting metal frame components to each other using a connector plate having outer faces joined to the inner faces of the components. FIGS. 6–8 illustrate the joinder of two metal framing components, such as the apex of rafters, that join at an angle.

FIGS. 1–2 illustrate a metal stud, generally 10, vertically positioned between upper and lower channel members, generally 12 and 14, respectively. Channel members, per se, are known in the relevant art, and include an elongated central wall with perpendicular parallel side walls. The side walls may extend upwardly, downwardly or horizontally, depending upon the application of the channel member.

C-shaped stud 10 is comprised of a side wall 16, ends walls 18 and 20 extending in the same direction at 90° angles from the side edges of wall 16, and flanges 22 and 24 parallel to wall 16 and extending inwardly from the forward edges of walls 18 and 20, respectively. Tabs 26 and 28 are integral with the opposed ends of wall 16, and extend inwardly at each end of stud 10 perpendicular to the axis of stud 10. Alternatively, it will be apparent that tab 26 and/or 28 can be integral with wall 18 and/or 20. Walls 18 and 20 also include access openings 30.

Lower channel member 12 is comprised of a lower horizontal wall 32 and parallel vertical walls 34 and 36 extending upwardly from the side edges of lower wall 32. The distance between walls 34 and 36 is approximately equal to the width of stud 10, so that stud 10 can be inserted perpendicularly into channel 12 onto wall 32 and between walls 34 and 36. Upper channel 14 is the mirror image of channel 12, and is comprised of an upper horizontal wall 38 and parallel vertical walls 40 and 42 extending downwardly from the side edges of upper wall 38. The distance between walls 40 and 42 is equal to the distance between walls 34 and 36.

A rectangular piece of double-sided adhesive tape 44 of the construction described above is adhered between the outer face of tab 26 and the upper surface of wall 32 to secure the lower end of stud 10 to channel member 12. Similarly, another piece of double-sized adhesive tape 46 is adhered between the outer face of tab 28 and the lower surface of wall 38 to secure the upper end of stud 10 to channel member 14. In this manner, stud 10 is rigidly held in the desired vertical position. If desired for code or other purposes, screws 48, normally of a self-tapping construction, can be inserted through adjacent walls of the two components.

In the formation of a wall, either an interior wall or an exterior wall, it will be understood that a plurality of evenly spaced studs can be secured between the channels 12 and 14 in the same manner. While stud 10, as illustrated in FIGS. 1–2, is perpendicular to channels 12 and 14, it will also be apparent that studs or other metal components can be similarly attached when at an angle, e.g., from 45° to 90°.

FIGS. 3–5 illustrate the attachment of abutting channel members 50 and 50' using a connector plate 52. Channel member 50 is comprised of a horizontal central wall 54, and vertical side walls 56 and 58 extending at 90° angles in the same direction from the edges of wall 54. Similarly, channel member 50' is comprised of a horizontal central wall 54', and vertical side walls 56' and 58' extending at 90° angles in the same direction from the edges of wall 54'.

As illustrated, walls 54 and 54' are top wall and walls 56, 56', 58 and 58' are side walls. It will be apparent, however, that the same attachment procedure is equally applicable to a lower channel member, or to a channel member in which the central wall is vertical and the side walls are horizontal.

Connector plate 52 is comprised of a central wall 60 and attached side walls 62 and 64. Wall 60 is adhered to the inner surfaces of walls 54 and 54' with a strip of double-sided adhesive tape 66; side wall 62 is adhered with double-sided tape 70 to the inner surfaces 56 and 56' with double-sided adhesive tape 68; and side wall 64 is adhered to the inner surfaces of walls 58 and 58'. It will be understood that one or more of the tape pieces can be omitted if less strength is needed.

FIGS. 6–8 illustrate the connection of abutting angular ends of two metal channel framing members, generally 72 and 74. Member 72 is comprised of an upper wall 76, opposed side walls 78 and 80, and a lower wall section 82 at the forward end of member 72. Section 82 is parallel to upper wall 76, and perpendicular to walls 78 and 80. Tabs 84 and 86 extend outwardly from the ends of walls 76 and 82, respectively.

Member 74 is constructed similarly to member 72, and is comprised of an upper wall 88, opposed side walls 90 and 92, and a lower wall section 94 at the forward end of member 74. Section 94 is parallel to upper wall 88, and perpendicular to walls 90 and 92. Tabs 96 and 98 extend outwardly from the ends of walls 88 and 94, respectively.

When joined, the lower surface of tab 84 is adhered to the outer surface of wall 88 with double-sided tape 100, the lower surface of tab 86 is adhered to the inner surface of wall 92 with double-sided tape 102, the upper surface of tab 96 is adhered to the inner surface of wall 76 with double-sided tape 104, and the upper surface of tab 98 is adhered to the outer surface of wall 82 with double-sided adhesive tape 106. For additional strength, plate 108 is adhered to side walls 78 and 90 with double-sided adhesive tape 110, and a similarly shaped plate 112 is adhered to side walls 80 and 92 with double-sided adhesive tape 114. It will be understood that tabs may extend forward from the side walls of members 72 and 74 for connection with the other members instead of, or in addition to, the above tabs.

Figure 10:
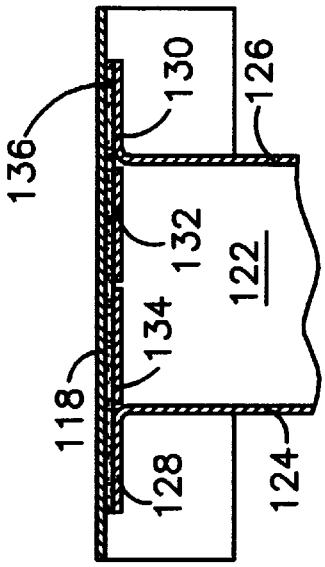
FIG. 10 is a sectional side view of the attached components of FIG. 9.
Figure 9:
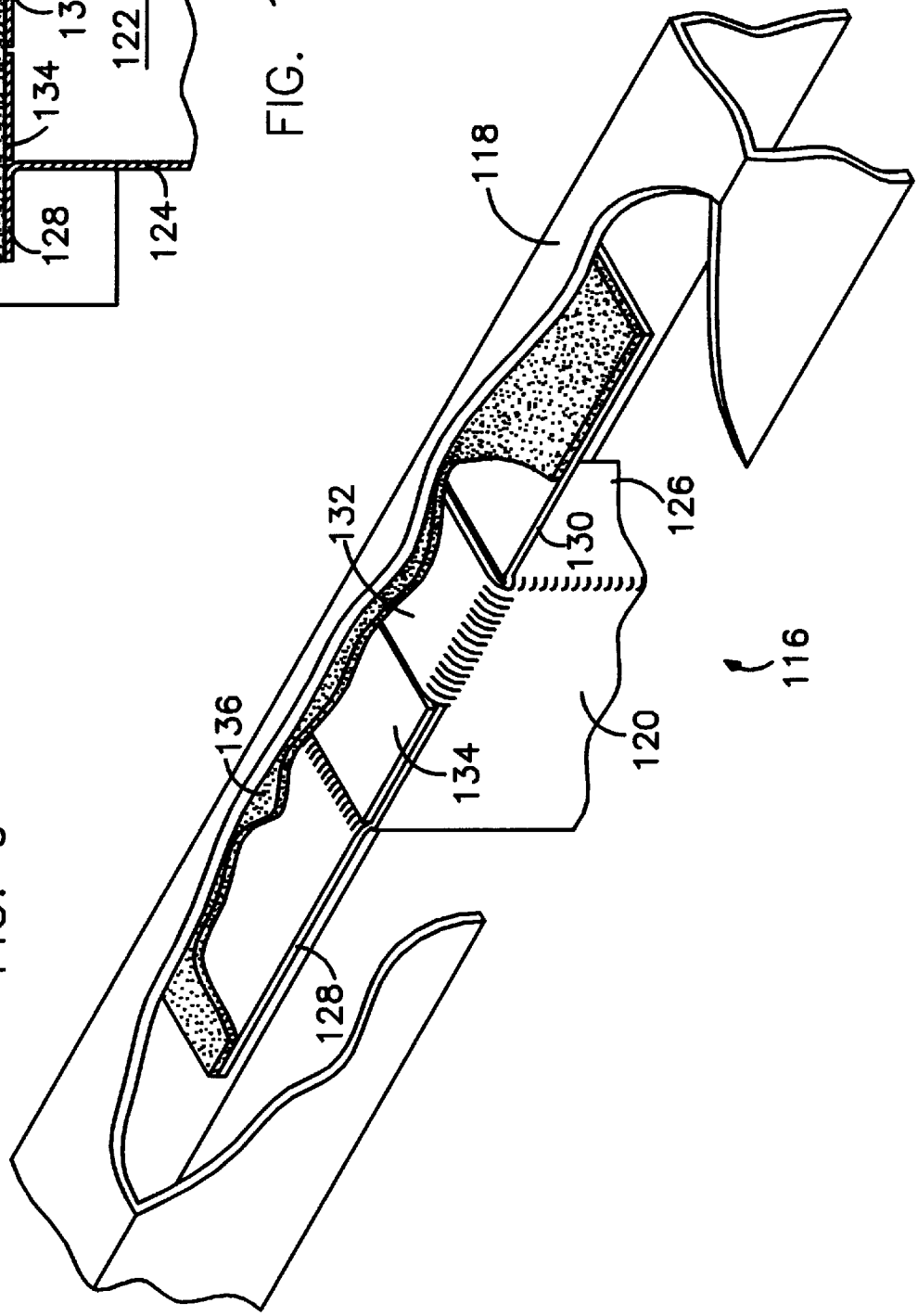
FIG. 9 a perspective view of an alternative way of attaching the end of a metal framing component to the wall of another component.

FIGS. 9–10 illustrate another attachment of the end of a metal framing component 116 to wall 118 of another component. Component 116 comprises opposed parallel side walls 120 and 122, joined by opposed parallel end walls 124 and 126. Tabs 128 and 130 extend outwardly from end walls 124 and 126, respectively, and lie in a common plane. Tabs 132 and 134 extend inwardly from walls 120 and 122, respectively, and also lie in a common plane with tabs 126 and 130, all of the tabs together forming a contact surface. A strip of double-sided adhesive tape 136 extends across the upper surface of the tabs and adheres the end of component 116 to the inner surface of wall 118. While the illustrated embodiment shows tabs extending inwardly from both end walls 124 and 126, it will be understood that the component can be formed with only one inwardly extending tab, or without any inwardly extending tab.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A frame of a building comprising:

a) a first metal framing component having a first connection surface;

b) a second metal framing component having a second connection surface; and c) double-sided adhesive tape adhering said first and second connection surfaces.

2. The frame of claim 1, wherein said tape is comprised of a closed-cell acrylic foam carrier tape, coated on both sides with a pressure sensitive adhesive.

3. The frame of claim 1, wherein said first metal framing component is a metal stud.

4. The frame of claim 1, wherein said second metal framing component is an attachment channel member.

5. The frame of claim 1, wherein said first metal framing component includes opposed ends and a tab extending from one of the ends of said component, said tab having a surface forming said first connection surface.

6. The frame of claim 1, wherein said component includes a wall and said tab extends from the end of said wall.

7. The frame of claim 6, wherein said tab extends from the end of said wall at an angle of from 30° to 90°.

8. A frame of a building comprising:

a) a first metal framing component having a side wall with parallel side edges, first and second end walls having first side edges integral with the edges of said side wall and forward edges, and a tab at the end of one of said walls, said tab having a first connection surface;

b) a second metal framing component having a wall with a second connection surface; and c) double-sided adhesive tape joining said first and second connection surfaces.

9. The frame of claim 8, wherein said tape is comprised of a closed-cell acrylic foam carrier tape, coated on both sides with a pressure sensitive adhesive.

10. The frame of claim 8, wherein said first framing component further includes tabs extending inwardly from the forward edges of said end walls.

11. The frame of claim 8, wherein said tab is at the end of said side wall.

12. The frame of claim 8, wherein said tab is at the end of one of said end walls.

13. The frame of claim 8, wherein said second framing component is an attachment channel having a center wall and side walls, and said center wall having an inner surface forming said second connection surface.

14. The frame of claim 8, having a first tab extending from said first end wall and a second tab extending from said second end wall.

15. The frame of claim 14, wherein said tabs extend outwardly from said end walls and lie in a common plane.

16. A frame of a building comprising:

a) a first component having a first wall;

b) a second component having a second wall, said first and second wall having abutting ends and lying in a common plane;

c) a connector plate having a connection surface; and d) double-sided adhesive tape connecting said connection surface to said first and second walls.

17. The frame of claim 16, wherein said tape is comprised of a closed-cell acrylic foam carrier tape, coated on both sides with a pressure sensitive adhesive.

18. The frame of claim 16, wherein said first and second components are channel members having central walls with inner surfaces, said connector plate being attached to said inner surfaces with double-sided adhesive tape.

19. The frame of claim 18, wherein said channels further include side walls, and said connector plate includes side walls, said channel member side walls being connected to said connector plate side walls with double-sided adhesive tape.

20. The frame of claim 18, wherein the ends of said components abut at an angle.

21. A frame of a building comprising:

a) a first component having a top wall, parallel side walls, a bottom wall, and a first tab extending from the end of one of said walls;

b) a second component having a top wall, parallel side walls, a bottom wall, and a second tab extending from the end of one of said walls;

c) double-sided adhesive tape joining said first tab to a wall of said second component; and d) double-sided adhesive tape joining said second tab to a wall of said first component.

22. The frame of claim 21, wherein said tape is comprised of a closed-cell acrylic foam carrier tape, coated on both sides with a pressure sensitive adhesive.

23. The frame of claim 21, wherein said first and second components abut at an angle.

24. The frame of claim 21, wherein said first tab extends from the top wall of said first component and is adhered with double-sided adhesive tape to the top wall of said second component, and said second tab extends from the bottom wall of said second component and is adhered with double-sided adhesive tape to the bottom wall of said first component.

* * * * *